114-253 SR
2/16/88 OR 4,724,788

United States Patent [19]

Ayers

[11] Patent Number: 4,724,788

[45] Date of Patent: Feb. 16, 1988

[54] FLOAT STEERING SYSTEM

[75] Inventor: Ray R. Ayers, Houston, Tex.

[73] Assignee: Shell Oil Company, Houston, Tex.

[21] Appl. No.: 657,465

[22] Filed: Oct. 3, 1984

Related U.S. Application Data

[63] Continuation of Ser. No. 516,155, Jul. 21, 1983, abandoned.

[51] Int. Cl.[4] ..... B63G 8/14

[52] U.S. Cl. ..... 114/253; 114/244; 114/245

[58] Field of Search ..... 43/9, 43.13; 244/1 TD, 244/153 R, 3; 441/21-27, 68; 114/243-245, 253, 168, 254, 311; 440/33, 34; 181/109-112, 122

[56] References Cited

U.S. PATENT DOCUMENTS

| | | | |
|---|---|---|---|
| 1,115,363 | 10/1914 | Wood | 441/21 |
| 1,853,794 | 4/1932 | Arman | 114/254 |
| 2,359,366 | 10/1944 | Katcher | 114/245 |
| 2,545,185 | 3/1951 | Winslow | 43/43.13 |
| 2,572,255 | 10/1951 | Gallaway | 441/21 |
| 2,933,848 | 4/1960 | Tollefson | 43/43.13 |
| 2,965,998 | 12/1960 | Kuismi | 43/43.13 |
| 3,470,649 | 10/1969 | Cole | 43/43.13 |
| 3,613,629 | 10/1971 | Rhyne | 114/254 |
| 3,813,809 | 6/1974 | Frotiee | 43/43.13 |
| 3,908,300 | 9/1975 | Kuismi | 43/43.13 |
| 4,323,989 | 4/1982 | Huckabee et al. | 367/17 |
| 4,350,111 | 9/1982 | Boyce | 114/245 |

FOREIGN PATENT DOCUMENTS

| | | | |
|---|---|---|---|
| 501529 | 3/1951 | Belgium | 114/244 |
| 81/03475 | 5/1980 | PCT Int'l Appl. | 114/245 |
| 1818 | of 1883 | United Kingdom | 114/168 |

*Primary Examiner*—Joseph F. Peters, Jr.
*Assistant Examiner*—C. T. Bartz

[57] ABSTRACT

A method and apparatus are provided for towing and steering a seismic subarray from onboard a tow vessel. The outboard reach of the seismic subarray, relative to the vessel, is controlled by an adjustable bridle connected to the seismic subarray, and turning of the subarray in coordination with turning of the vessel is done using both the bridle and a rudder located at the rear of the seismic subarray.

4 Claims, 2 Drawing Figures

FLOAT STEERING SYSTEM

This is a continuation of application Ser. No. 516,155, filed July 21, 1983 now abandoned.

BACKGROUND OF THE INVENTION

In offshore seismic operations it has become increasingly desirable to tow gun subarrays farther and farther outboard of the vessel, in order to tow a greater number of subarrays and to spread the subarrays wider apart. This creates a better seismic source due not only to reduced interference between the subarrays but also due to a better defined three-dimensional picture of oil bearing strata. Not only is it desirable to use more subarrays which are spread farther outboard of the vessel, but it also is useful to have longer subarrays to accommodate more seismic guns. The result is very long floats, for example, 60 feet or longer, which are quite difficult to maneuver and control. Accordingly, a significant problem in the art is how to actively position and steer a large number of such floats remotely from a tow vessel, in an orderly, precisely and widely spaced pattern.

SUMMARY OF THE INVENTION

It is a primary purpose of this invention to provide a method and apparatus which solves the above described problems of the art and which can be utilized to deploy and remotely steer a large number of seismic subarrays in an orderly, precisely and widely spaced pattern behind a tow vessel.

The above purpose, as well as other purposes and objects of the invention are achieved by providing a method for towing a steerable floating elongated body such as a seismic subarray float, from onboard a vessel by connecting a bridle to the towed body, a fore leg of the bridle being attached at a fore section of the towed body and an aft leg of the bridle being attached near the midsection of the towed body; positioning the towed body outboard of the vessel by means of a tow line connected to the bridle junction between the fore leg and the aft leg; and steering the towed body by controlling the relative lengths of the fore leg with respect to the aft leg of the bridle. Preferably, a rudder is attached to the towed body and the rudder is utilized to turn the towed body in coordination with turning the vessel, without creating slack in the fore leg of the bridle. More preferably, a safety chain is employed in conjunction with the fore leg of the bridle which limits the outboard reach of the towed body, and in practice, the forward bridle cable can be extended enough to cause the safety chain to withstand the force. Most preferably, the towed body is a seismic subarray but it can also be a towed "flash", etc.

Other purposes, advantages and features of the invention will be apparent to one skilled in the art on review of the following.

DESCRIPTION OF THE PREFERRED EMBODIMENTS

Figure 1:
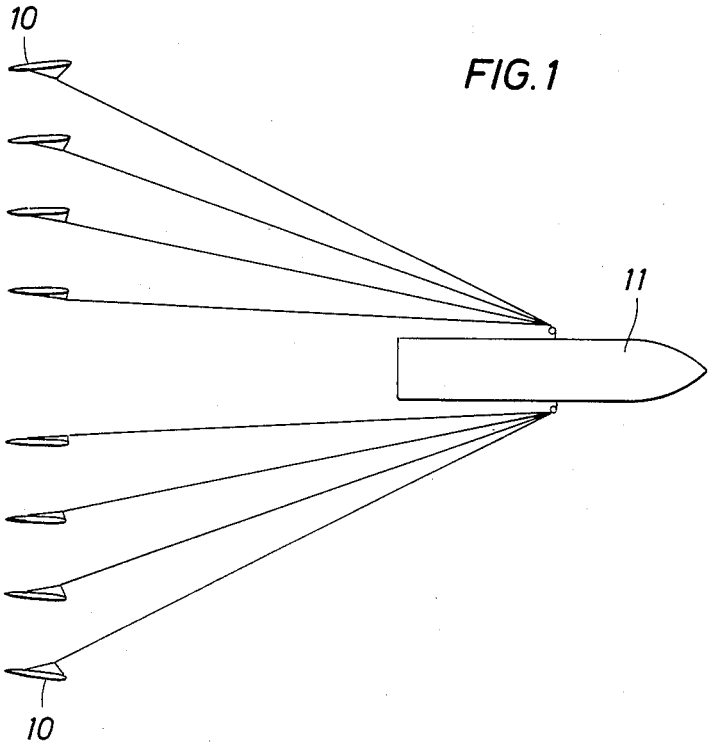
FIG. 1 shows a geophysical research vessel towing a configuration of seismic subarrays.

As shown in FIG. 1, it is feasible to tow a large number of seismic subarrays which are spread farther outboard of vessel 11 in order to accommodate the large number. As mentioned, this creates a better seismic source, not only due to a better defined three-dimensional figure of oil bearing strata, but also due to reduced interference between the subarrays.

Figure 2:
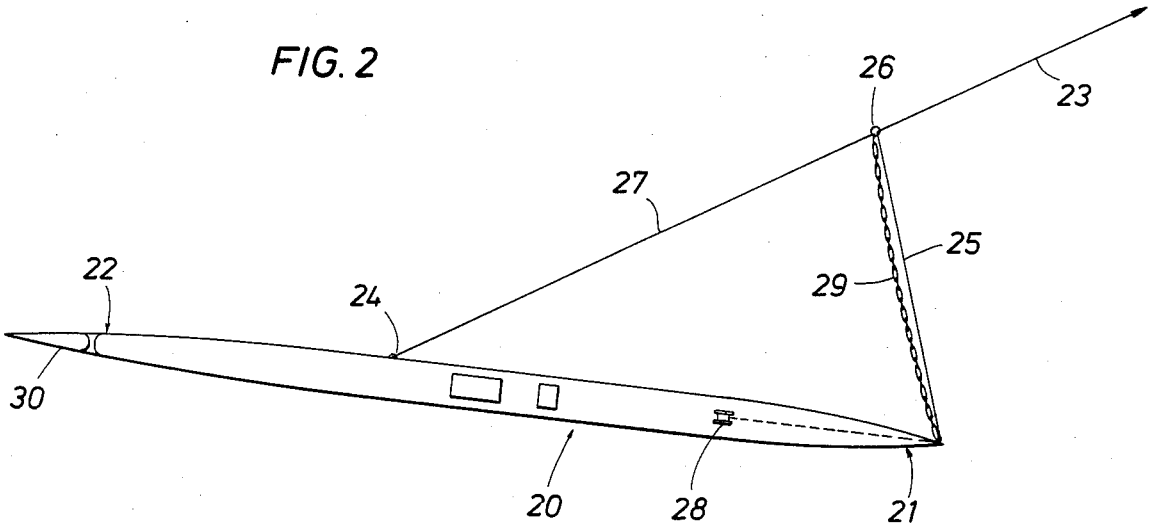
FIG. 2 provides a view of a single seismic subarray under tow in accordance with the present invention.

As more particularly shown in FIG. 2, a seismic subarray or other towed body 20 having a bow 21 and stern 22 is towed outboard a vessel (not shown) via a tow line 23 which may also function as an umbilical cable. The umbilical cable 23 terminates just aft of midship of the float 20 at termination point 24. A cable 25, preferably wire rope, extends from the bow 21 of float 20 and attaches to the umbilical cable 23, such that the distance between the attachment point 26 and the termination point 24 of the umbilical cable is nearly the same as the distance from the termination point 24 to the bow 21 of the float 20. Cable 25 is hereinafter termed the fore leg of a bridle which also includes an aft leg 27 which extends from attachment point 26 to termination point 24. A winch 28 just inside the float 20 is provided which has the ability to shorten or lengthen fore leg 25, thereby changing the offset distance of the float from the tow vessel while it is under tow. Preferably, the winch is powered by a hydraulic motor (not shown) which brings in the fore leg 25 of the bridle cable to allow recovery of the float or pays out fore leg 25 to allow deployment of the float. The maximum let-out of the fore leg 25 of the bridle is limited by safety chain 29 which is of a predetermined length in order to preset the desired bridle arrangement. It would be expected to use a preset safety chain length for each float in a multiple float array, and the chain length on each float would be different depending upon its desired position behind the tow vessel. Accordingly, the winch 28 would only be used to pull the bridle in and to let it out during deployment and recovery.

A secondary use of the hydraulic bridle winch 28 is to assist rudder 30 in turning float 20 as the tow vessel turns. Turning the float with the bridle is feasible when the float is positioned on the far outboard side of a turn by the vessel and is broadside to where the vessel is attempting to turn. By this means, it is possible to generate exorbitant drag force on the float in turning the float around more to facing the vessel.

While a front-located rudder may be used, such a location in unnecessarily complicating, and it is more desirable to place the rudder at the rear of the float as shown. Inasmuch as it is necessary to generate hydraulic power for the winch 28, it is feasible to divert some of the hydraulic power and use it for control of rudder 30. The rudder on the float is turned in the same direction as the rudder for the tow vessel. The key to making the turning operation work well in both directions is to have the aft leg 27 of the bridle coming in just aft of the midship of the float 20 so that structural termination 24 is very close to the center of turning and therefore allows the rudder to operate properly. Accordingly, the location of the bridle is critical, with the fore leg 25 of the bridle preferably going to the bow 21 of the float and the aft leg 27 preferably going slightly aft of the center of the float. For example, in the instance of a 60-foot float, the aft leg 27 is connected about 4 feet aft of the center of the float, and this achieves a float which is readily turnable with the rudder 30 in either direction.

The foregoing description of the invention is merely intended to be explanatory thereof. Various changes in the details of the described apparatus may be made within the scope of the appended claims without departing from the spirit of the invention.

What is claimed is:

1. A method for towing a seismic subarray float in an adjustable outboard reach behind a towing vessel, comprising:

connecting a bridle to the float, a fore leg of the bridle being attached to a fore section of the float and an aft leg of the bridle being attached to a mid-section of the float;

towing the float behind the vessel by means of a towline connected to the bridle at the junction of the fore leg and the aft leg; and adjusting the let-out of the fore leg of the float during towing to determine the outboard reach of the float.

2. The method of claim 1 wherein a motorized winch in the float is utilized to adjust the length of the fore leg during towing.

3. An apparatus for towing a seismic subarray float in an adjustable outboard reach behind a towing vessel, comprising:

means for connecting a bridle to the float, a fore leg of the bridle being attachable to a fore leg of the float and an aft leg of the bridle being attachable to the mid-section of the float;

a tow line connected to the bridle at the junction of the fore leg and the aft leg and functionable to tow the float behind a vessel; and means for adjusting the let-out of the fore leg of the float during towing to determine the outboard reach of the float.

4. The apparatus of claim 3 wherein a motorized winch in the float is operative to adjust the length of the fore leg during towing.

* * * * *